US007614919B2

(12) United States Patent
Gherardini et al.

(10) Patent No.: US 7,614,919 B2
(45) Date of Patent: Nov. 10, 2009

(54) BUSSING CONNECTOR

(75) Inventors: Stephen Daniel Gherardini, Harrisburg, PA (US); Christopher George Daily, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/746,153

(22) Filed: May 9, 2007

(65) Prior Publication Data

US 2008/0277161 A1 Nov. 13, 2008

(51) Int. Cl.
*H01R 24/00* (2006.01)

(52) U.S. Cl. ..... 439/676

(58) Field of Classification Search ..... 439/676, 439/669, 595, 521, 694, 466, 352, 689
See application file for complete search history.

(56) References Cited

U.S. PATENT DOCUMENTS 3,087,137 A 4/1963 Linn
4,295,181 A 10/1981 Chang et al.
4,310,211 A * 1/1982 Bunnell et al. ..... 439/358
4,460,232 A 7/1984 Sotolongo
5,104,253 A 4/1992 Zielinski et al.
5,338,369 A 8/1994 Rawlings
5,578,861 A 11/1996 Kinoshita et al.
5,746,839 A 5/1998 Dinwoodie
5,902,156 A 5/1999 Geebelen et al.
6,109,973 A 8/2000 Gronowicz et al.
6,111,189 A 8/2000 Garvison et al.
6,250,952 B1 * 6/2001 Shiga et al. ..... 439/466
6,465,724 B1 10/2002 Garvison et al.
6,501,013 B1 12/2002 Dinwoodie
6,553,729 B1 4/2003 Nath et al.
6,582,249 B1 6/2003 Boeck et al.
6,875,914 B2 4/2005 Guha et al.
6,912,816 B2 7/2005 O'Leary
6,921,293 B2 * 7/2005 Takada et al. ..... 439/582
6,928,775 B2 8/2005 Banister
7,059,916 B2 * 6/2006 Nishide ..... 439/686

(Continued)

FOREIGN PATENT DOCUMENTS

WO WO 2006/074561 7/2006

(Continued)

OTHER PUBLICATIONS

Faston Terminals, (Insulated and Uninsulated) Catalog 82004, Revised Jun. 2004, pp. 3-5; p. 21.

(Continued)

*Primary Examiner*—Jean F Duverne

(57) ABSTRACT

A low-profile electrical connector and connector system having a connector body. The connector body includes at least one bussing interconnection capable of electrically connecting to electrical devices and including at least one structure configured to receive a receptacle body having a plurality of arms configured to apply a contact force in the direction of an opposing plate. The connector body also includes an opening configured to receive a corresponding plug. The connector body further includes a plurality of latch arms having features that engage the plug and extension arms extending from the body and being in close proximity with the latch arms. The engagement of the opening and the corresponding plug form a seal that substantially prevents the infiltration of moisture into the connector body.

24 Claims, 6 Drawing Sheets

U.S. PATENT DOCUMENTS

| | | | | |
|---|---|---|---|---|
| 7,086,908 | B2 * | 8/2006 | Fukuzaki et al. | 439/669 |
| 7,097,516 | B2 | 8/2006 | Werner et al. | |
| 2007/0026721 | A1 | 2/2007 | Whyne et al. | |
| 2008/0160819 | A1 * | 7/2008 | Daily et al. | 439/358 |

FOREIGN PATENT DOCUMENTS

| | | |
|---|---|---|
| WO | WO 2007/005111 | 1/2007 |
| WO | WO 2008/085507 | 7/2008 |

OTHER PUBLICATIONS

Sunslates Installation Manual; Atlantis Energy Systems; Ver Jun. 10, 2002; Sacramento, CA.

* cited by examiner

BUSSING CONNECTOR

FIELD OF THE INVENTION

The present invention relates to bussing connectors used for interconnecting a plurality of electrical devices. In particular, the present invention is directed to interconnecting power contacts for a plurality of electrical circuits.

BACKGROUND OF THE INVENTION

There is currently an effort to utilize electrical circuitry in building structural components and other products in order to generate electricity or provide additional functionality to the components or products.

Circuits utilized for building products or other applications requiring a series of individual circuits to be electrically linked together suffer from the drawback that connections between these circuits typically require wiring and soldering. Individual wiring and/or soldering of the connections between individual circuits increases the amount of time required for installation and does not easily permit the replacement of individual circuits. In addition, wiring or electronic components are undesirably visible or are obstructed by assembly building components themselves. Wiring having reduced thicknesses have the drawback that they are generally fragile and susceptible to damage and/or loss of effectiveness when exposed to conditions typical for building components. Furthermore, wiring having reduced thicknesses typically do not have the ability to conduct the currents necessary for some building product circuit components.

What is needed is a connector that allows the connection of individual circuits, which provides excellent electrical contact, has a reduced thickness to reduce visibility and/or building component obstruction, allows easy connection and/or disconnection of the circuits to decrease the time and complexity required to install, replace and/or repair individual circuits and provides resistance to moisture or other contaminants to which the connector may be exposed.

SUMMARY OF THE INVENTION

An embodiment of the present invention includes a low-profile electrical connector having a connector body. The connector body includes at least one bussing interconnection capable of electrically connecting to electrical devices and including at least one structure configured to receive a receptacle body having a plurality of arms configured to apply a contact force in the direction of an opposing plate. The connector body also includes an opening configured to receive a corresponding plug. The connector body further includes a plurality of latch arms having features that engage the plug and extension arms extending from the body and being substantially coplanar with the latch arms. The engagement of the opening and the corresponding plug form a seal that substantially prevents the infiltration of moisture into the connector body.

Another embodiment of the present invention includes an electrical bussing system having: a low-profile electrical connector having connector body. The connector body includes at least one bussing interconnection. The connector body also includes an opening configured to receive at least one plug and includes a plurality of latch arms having features that engage the at least one plug. The latch arms have corresponding extension arms extending from the connector body and being substantially coplanar with the latch arms. At least one plug includes a receptacle having a plurality of arms configured to apply a contact force in the direction of an opposing plate and being connectable to a structure of the at least one bussing interconnection. The engagement of the opening and the plug form a seal that substantially prevents the infiltration of moisture into the connector body.

An advantage of an embodiment of the present invention is that circuits associated with building components may be interconnected with few or no solder or wiring connections.

Another advantage of an embodiment of the present invention is that the connectors have a low profile, wherein the thickness of the connectors do not obstruct adjacent building products or circuits related thereto.

Still another advantage of an embodiment of the present invention is that circuits may be connected together from locations that are remote from one another or are arranged in a plurality of spatially placed banks.

Still another advantage of an embodiment of the present invention is that the arrangement combines to a sealing mechanism to prevent water or other contaminants from intrusion into the connector interface.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers are used throughout the drawings to refer to the same or like parts.

DETAILED DESCRIPTION OF THE INVENTION

Figure 1:
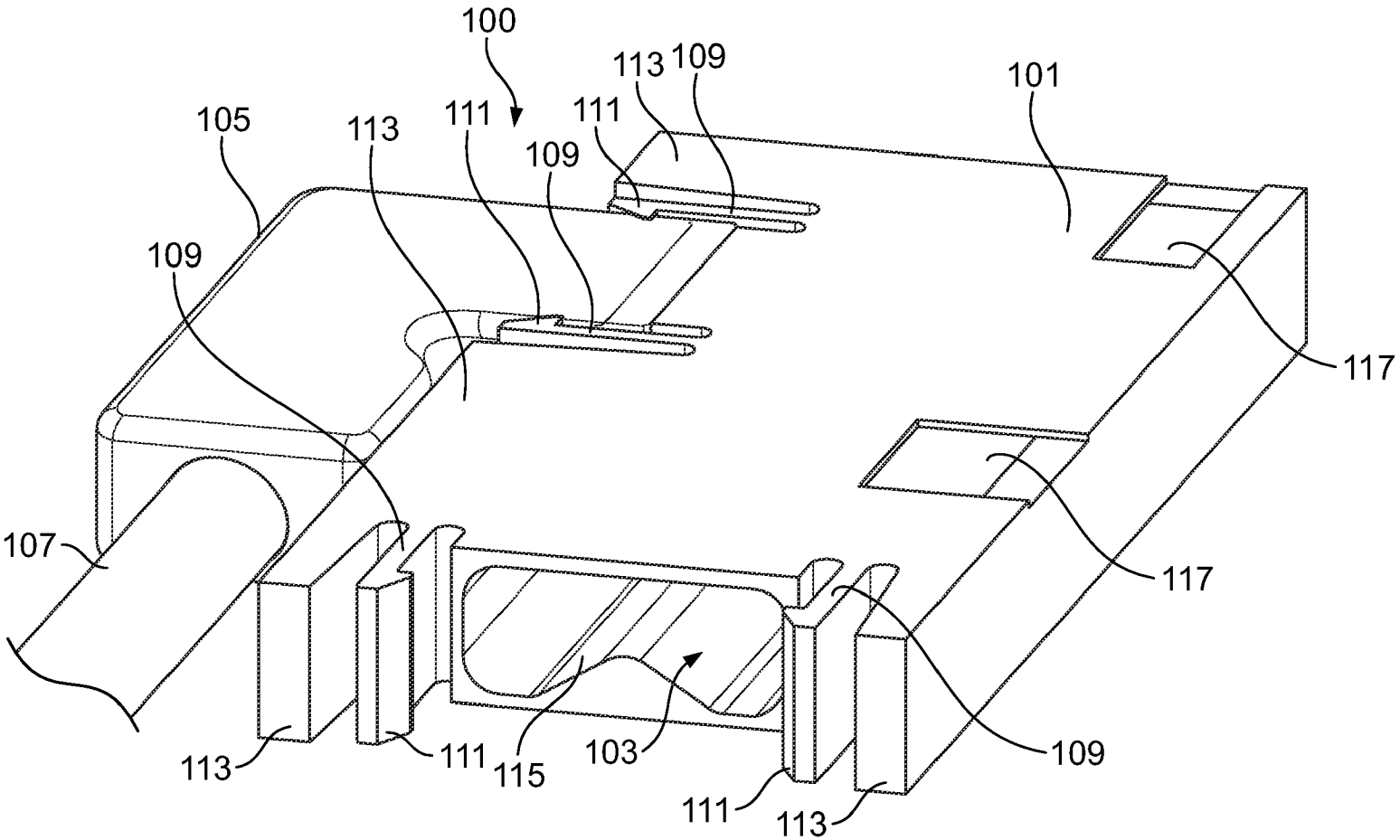
FIG. 1 shows a perspective top view of a connector and plug according to the present invention.

FIG. 1 shows an electrical connector 100 according to an embodiment of the present invention. Electrical connector 100 includes a connector body 101 having two connector openings 103 arranged to receive corresponding plugs 105. As shown in FIG. 1, one of the connector opening 103 includes an engaged plug 105. The plug 105 electrically connects wire 107 to a bussing interconnection 301 (see e.g., FIG. 3) within connector 100. Plug 105 is retained within opening 103 by latch arms 109 each having latch features 111, which engage a corresponding retention feature 201 of plug 105 (see e.g., FIG. 2). Connector body 101 further includes extension arms 113 that have a profile similar to arms 109 and are preferably arranged in close proximity to latch arms 109 such as to provide protection against damage or breakage by forces, such as impact or abrasions, particularly during installation or handling. The connector body 101 and the corresponding structures, such as latch arms 109 and the extension arms 113 have a thickness that is sufficiently small as to provide little or no obstruction to components being connected. Therefore, latch arms 109 have a correspondingly limited material strength wherein protection or support, such as the protection and/or support of extension arms 113, provide additional resistance to breakage and/or damage. Opening 103 further includes connector features 115, which provide surfaces to which the plug 105 may engage. Connector features 115 may provide surfaces which provide sealing connections, alignment of the plug 105 and or retention of the plug 105. Connector features 115 may include, but are not limited to latches, ribs, threads, quick connection arrangements, locking surface or any other retention arrangement that allows sealing, alignment and/or retention of plugs 105. In addition, plug 105 may be configured with a geometry, such as, but not limited to an asymmetrically mating geometry, that permits insertion of only plugs 105 having corresponding geometries (see e.g., FIGS. 1 and 2), providing for reliable and consistent connection. In addition, opening 103 may include a taper to receive plug 105 and provide guidance during plug 105 insertion. Connector 100 further includes contacts 117. Contacts 117 have an exposed conductive surface capable of providing electrical connections to circuits. Connections to the circuits are not particularly limited and may be by mechanical connection with solder, clips or other conventional electrical connection devices. The contact 117 is electrically isolated from each other or bridged with a diode or other electrical device (see, e.g., FIG. 3). The connector body 101 and the corresponding structures, including the latch arms 109, extension arms 113, and connector features 115, may be constructed of a substantially rigid, electrically insulating material, such as an acrylonitrile butadiene styrene (ABS) plastic or other suitable material.

Figure 2:
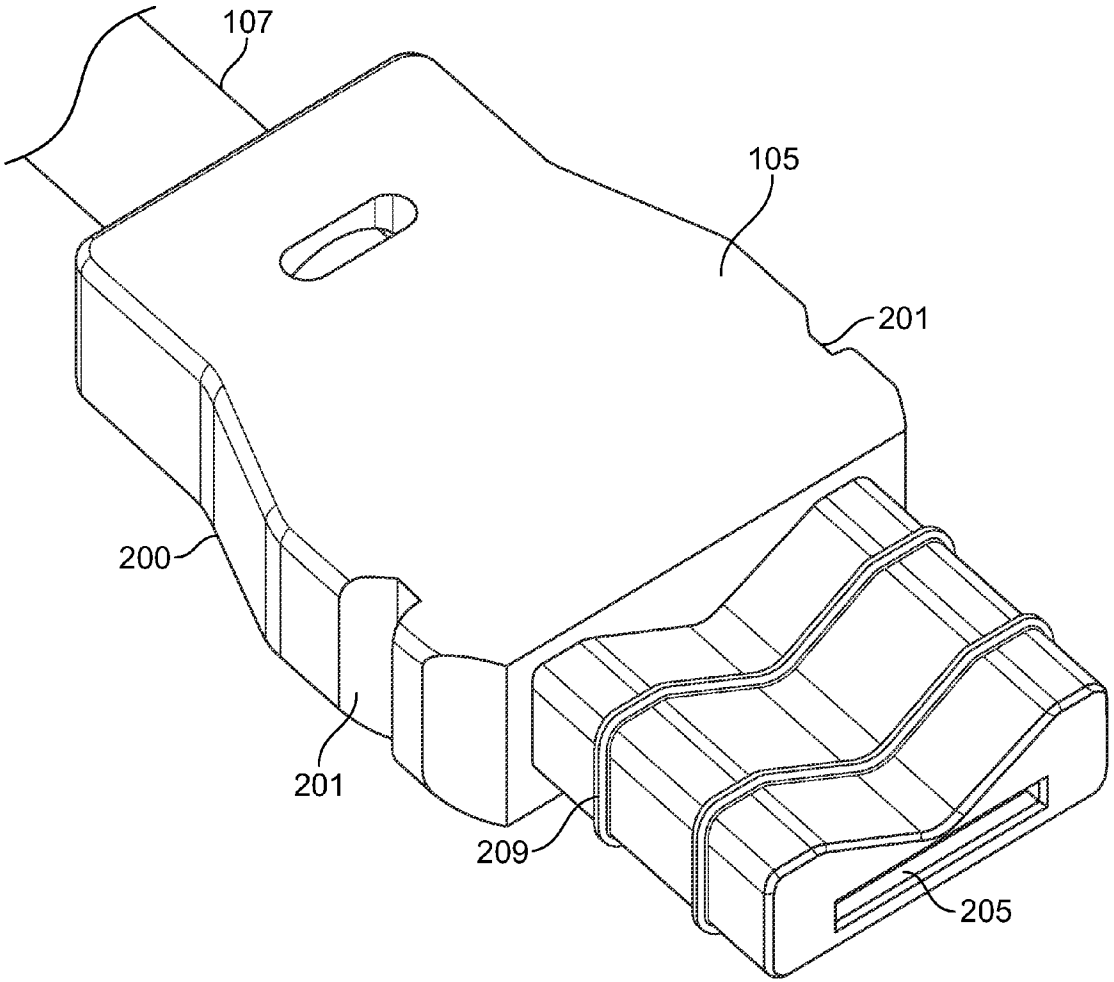
FIG. 2 shows a perspective top view of a plug according to an embodiment of the present invention.

FIG. 2 shows a perspective top view of plug 105 according to an embodiment of the present invention. The plug 105 includes retention features 201 formed into sides of the body 200 and includes a geometry configured to engage latch features 111 of latch arms 109. In a preferred embodiment, the retention features 201 engage latch features 111, releasably retaining plug 105 and preventing relative motion between plug 105 and connector body 101. While not so limited, the retention features 201 may include ledges or indentations in the body 200 having sufficient depth and exposed surface area to engage the latch features 111 of the latch arms 109. In an alternate embodiment, retention features 201 may include protrusions in the body 200 of sufficient magnitude to engage latch features 111 having indentations (not shown) or combinations thereof.

In addition, plug 105 includes plug features 209, which provide friction and/or sealing of the plug 105 into connector 100. Engagement of the plug features 209 with the connector features 115 provide environmental resistance for the connector 100. In other words, the engagement of the plug features 209 with the connector features 115 may provide a substantially fluid tight seal, which helps prevent infiltration of moisture or other contaminants into the connector 100. While not so limited, the plug features 209 may be ribs or raised splines that are arranged to provide a substantially moisture resistant seal. In addition, the plug features 209 may include latches, threads, quick connection arrangements, locking surface or any other suitable engagement arrangement. A plug opening 205 is disposed at an end of the plug 105. Plug opening 205 provides an opening configured to receive a portion of contacts 117 disposed within the connector 100 (see, e.g., FIG. 3). The plug 105 and the plug features 209 are constructed of a soft durometer, electrically insulating material, such as a thermoplastic elastomer or other suitable material.

Figure 3:
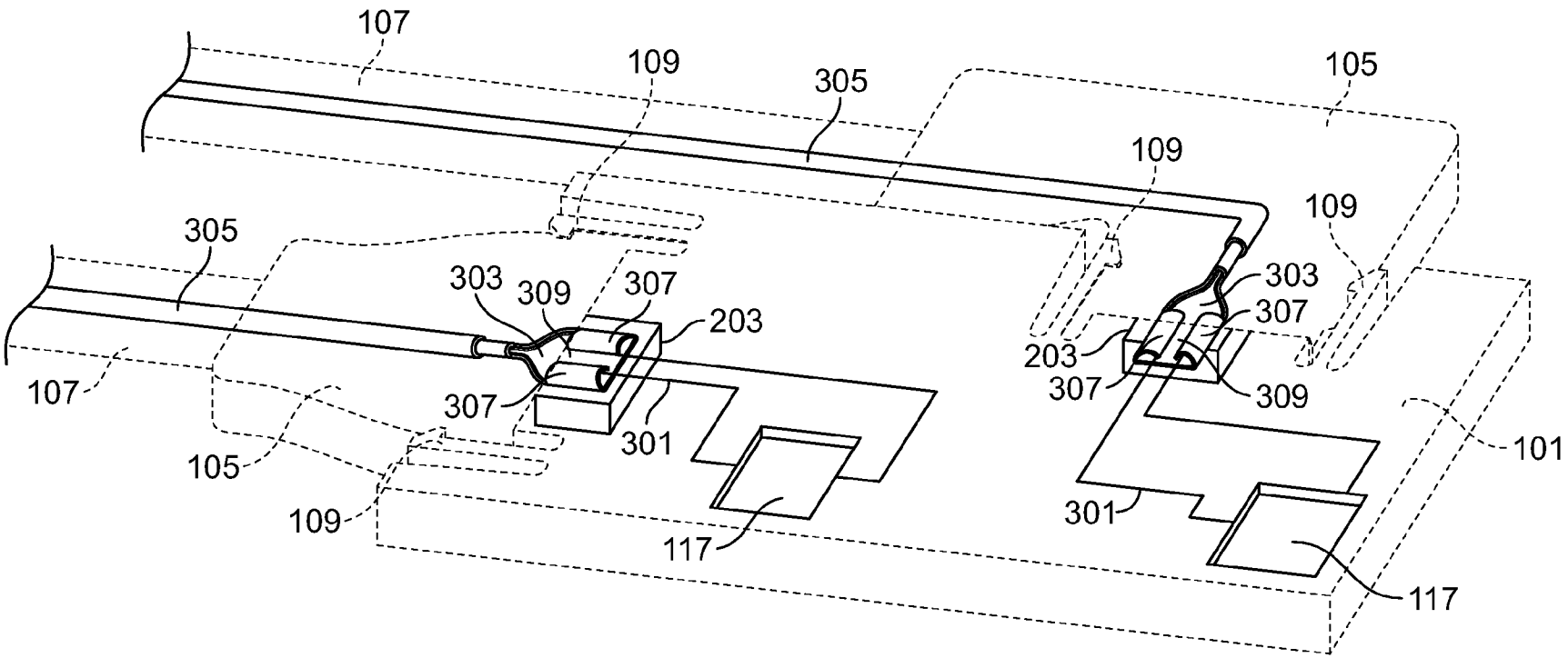
FIG. 3 shows a partially exposed perspective top view of an arrangement of a connector and circuits according to an embodiment of the present invention.

FIG. 3 shows a cutaway view of a connector 100 according to an embodiment of the present invention. The connector body 101 and plugs 105 are shown in broken lines, wherein the components within the connector 100 are shown. The connector 100 according to this embodiment of the invention provides contacts 117 that permit connection of connector 100 with one or more electrical circuits (not shown). The connector 100 preferably includes a plurality of bussing interconnections that electrically connect contacts 117 with plugs 105. The arrangement of bussing interconnection 301 is not particularly limited and may be any arrangement of wires 107, conductive plates, printed circuit boards or any other electrically conductive device that provides electrical connectivity between the contacts 117 and the corresponding plug 105. Bussing interconnection 301 also preferably includes a tabular geometry or other suitable geometry for receiving receptacle 303. In addition, electronic circuitry and hardware may be utilized within the bussing interconnection 301 to provide functionality to the connector 100. For example, diodes may be located within the bussing interconnection 301 to connect and control the flow of electricity between bussing interconnections 301. Plug 105 includes a receptacle 303 in electrical communication with a conductor 305. The receptacle 303 is made up of receptacle body 400 (see e.g., FIG. 4) having a plurality of arms 307 configured to apply a contact force in the direction of an opposing plate 401 (not shown in FIG. 3; see e.g., FIG. 4). The arrangement of the arms 307 allows repeatable insertion and retention of a tabular protrusion 309 wherein the contact force further provides an electrical connection, when engaged. Connector 100 has at least one dimension that has a low profile. That is, there is preferably a dimension representing a thickness of less than about 0.5 inches, more preferably less than about 0.3 inches. In one embodiment, the connector 100 has a thickness measured in a direction perpendicular to the direction in which plug 105 is inserted of about 0.25 inches. To fabricate the connector 100, ABS plastic or other substantially rigid, electrically insulating material is overmolded onto the bussing interconnection 301, wherein the structures, such as the latch arms 109, the extension arms 113 and the connector features 115 are molded into the connector 100.

Figure 4:
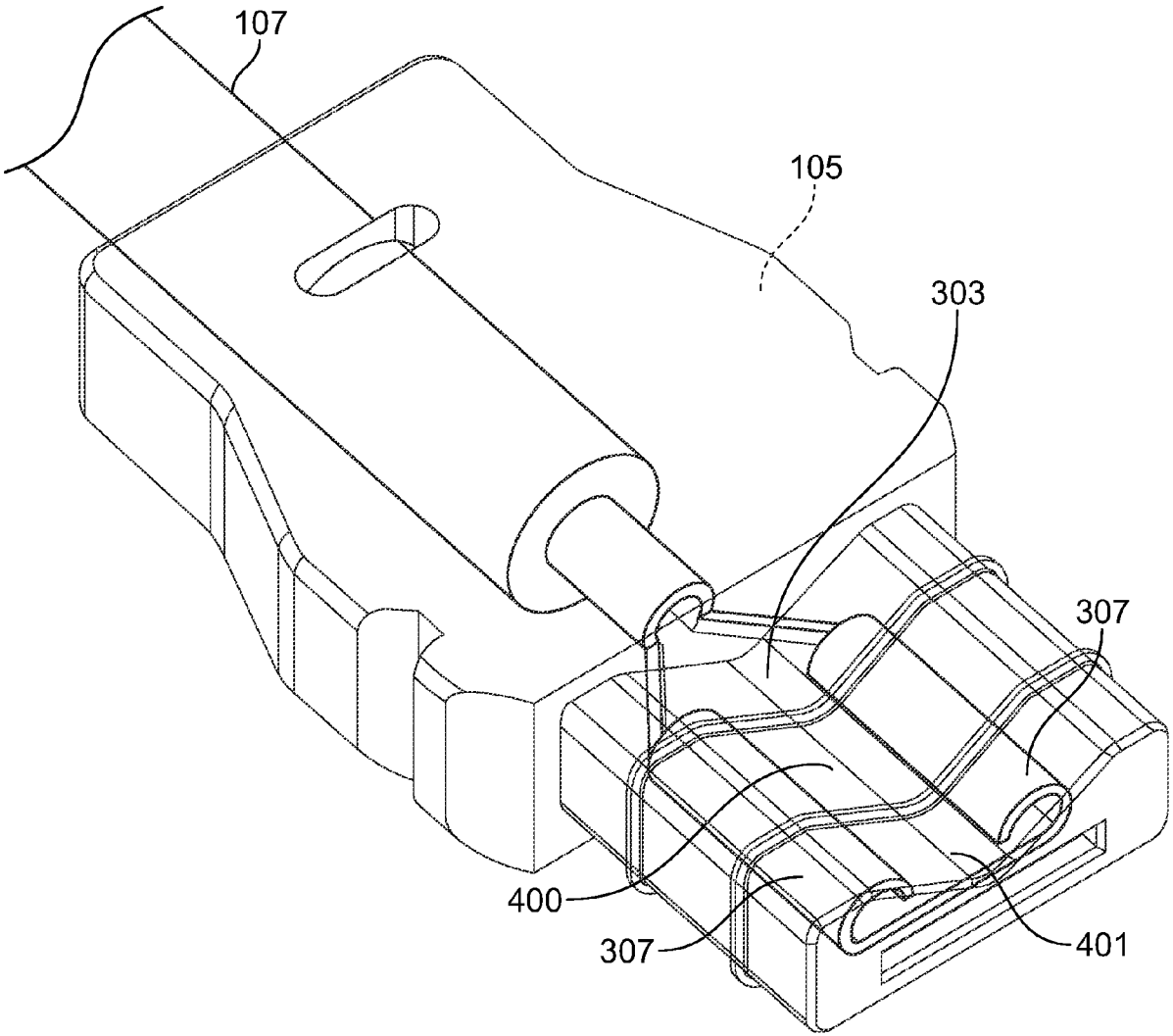
FIG. 4 shows a partially exposed perspective top view of a parallel plug according to an embodiment of the present invention.

FIG. 4 shows a partially exposed view of a plug 105 with the internal components of the plug 105 shown. Plug 105 includes a wire 107 that is in electrical communication with a receptacle 303. Receptacle 303 includes a receptacle body 400 having a plurality of arms 307 configured to apply a contact force in the direction of an opposing plate 401. Receptacle 303 may be fabricated from any suitable electrically conductive material, including but not limited to copper or copper alloys. The receptacle body 400 is configured to receive a tabular protrusion 309 (e.g., FIG. 3), which may include any structure that may be retained by the force of arms 307 toward opposing plate 401 and provided an electrical connection. To fabricate the plug 105, a soft durometer, electrically insulating material is overmolded onto the wire 107 and/or the receptacle 303, wherein the structures, such as the plug features 209 are molded into the plug 105.

Figure 5:
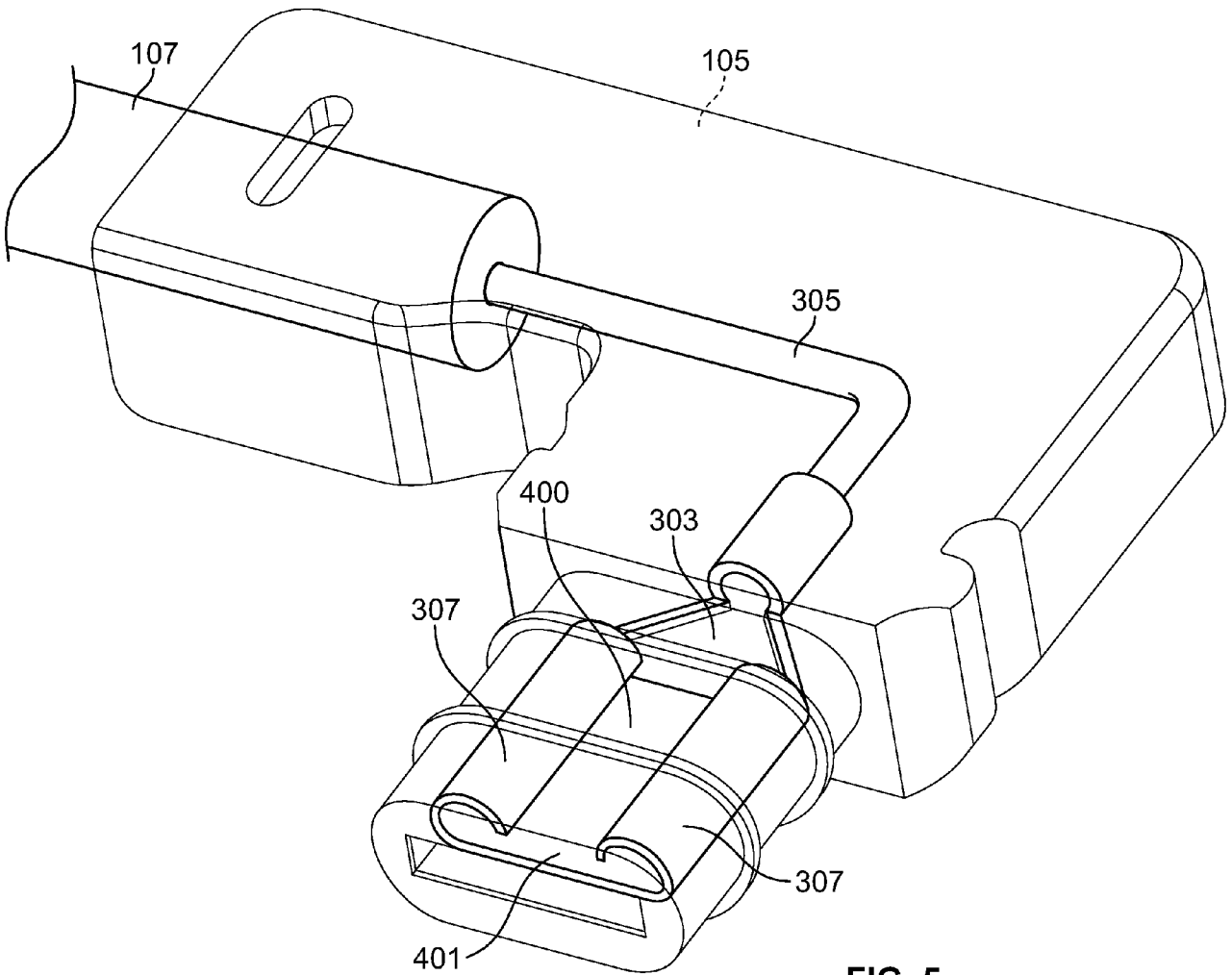
FIG. 5 shows a partially exposed perspective top view of a perpendicular plug according to an embodiment of the present invention.

FIG. 5 shows another embodiment of the present invention, including a right angle plug 105, which may be engaged with connector 100. While the embodiment shown and described above includes a plug 105 arranged substantially parallel to a portion of wire 107 and a plug 105 arranged substantially perpendicular to a portion of wire 107 (i.e., at a right angle to the wire 107), the plugs 105 may be arranged in any manner that provides ease of installation and provides minimal or no obstruction to circuits electrically connected thereto.

Figure 6:
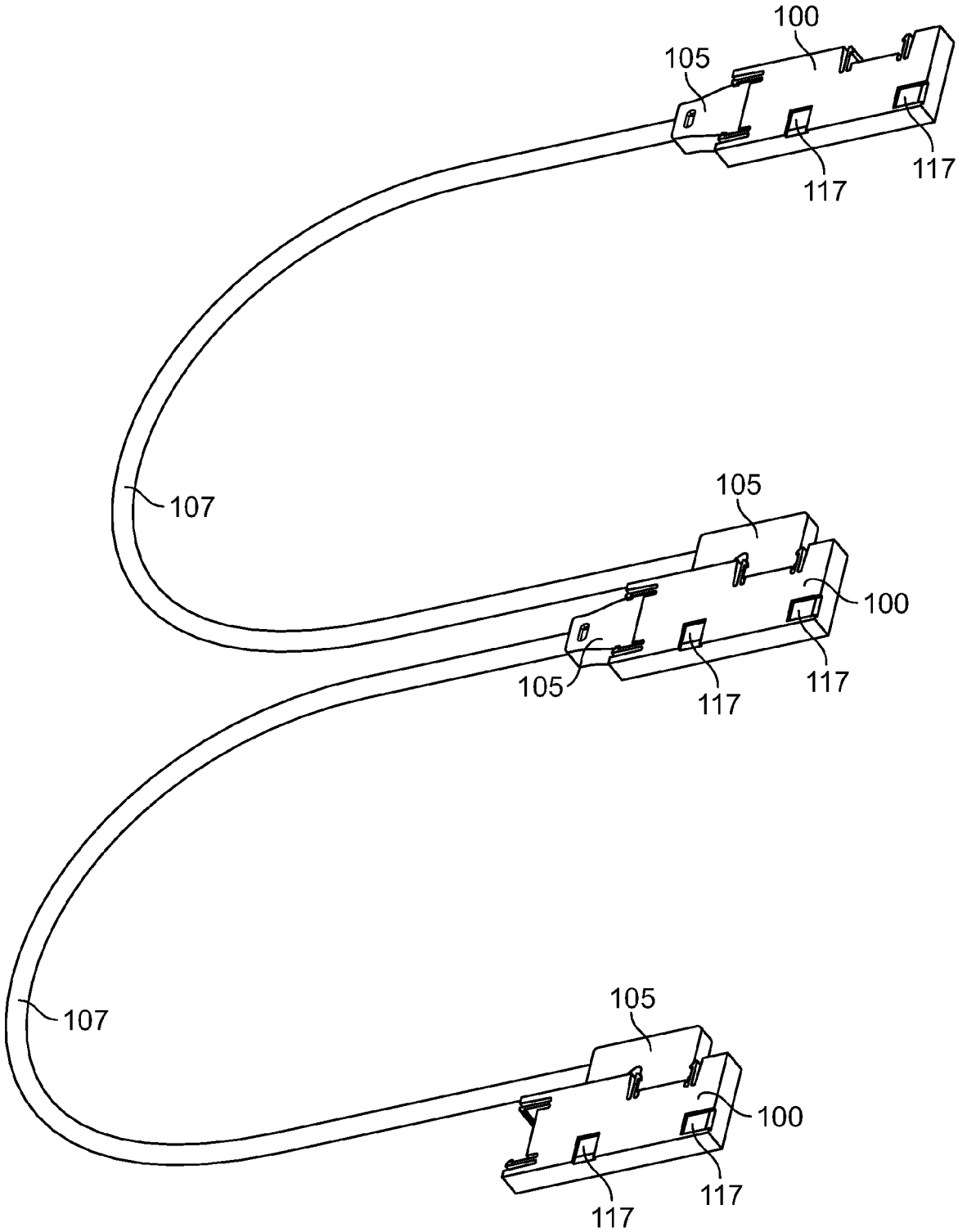
FIG. 6 shows a perspective top view of a connector and wire plug system according to another embodiment of the present invention.

FIG. 6 shows an embodiment of the invention showing a system of connectors 100 with a plurality of connectors 100 having a plug 105 and wire 107 arrangement showing exemplary configuration through which electricity may be bussed. Although not shown, electrical circuits, such as photovoltaic cells, may be electrically connected to contacts 117 and power may be bussed through additional attached connectors 100. Connections to the circuits are not particularly limited and may be by mechanical connection with solder, clips or other conventional electrical connection devices. The plug 105 to connector 100 engagement permits bussing of electricity from a plurality of circuits, arranged at various locations across a structure, reducing or eliminating the need for wires 107 or solder in order to interconnect connectors 100. In addition, terminators or other electrical devices may be incorporated into the system to complete the circuits and/or provide the desired functionality.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A low-profile electrical connector comprising a connector body having at least one bussing interconnection, the at least one bussing interconnection capable of electrically connecting to electrical devices and including at least one structure configured to receive an electrically conductive receptacle body having a plurality of arms connected at opposite sides of an opposing plate, the plurality of arms configured to apply a contact force to the at least one structure in the direction of the opposing plate;

the connector body comprising an opening configured to receive a corresponding plug, the connector body further comprising a plurality of latch arms having features that engage the plug, the latch arms having corresponding extension arms extending from the body and parallel and adjacent the latch arms to provide protection against damage or breakage to the latch arms; and wherein the engagement of the opening and the corresponding plug form a seal that substantially prevents the infiltration of moisture into the connector body.

2. The connector of claim 1, wherein the opening comprises a feature for engagement with the plug.

3. The connector of claim 2, wherein the opening includes connector features configured to align and retain the plug.

4. The connector of claim 2, wherein the opening includes connector features that provide a moisture resistant seal when engaged with the at least one plug.

5. The connector of claim 2, wherein the opening comprises a tapered surface.

6. The connector of claim 1, wherein the latch arms include latch features that engage at least one surface of the at least one plug.

7. The connector of claim 1, wherein the extension arms are formed into the connector body.

8. The connector of claim 1, wherein the electrical devices are photovoltaic cells.

9. The connector of claim 1, wherein the structure is a tabular protrusion.

10. The connector of claim 1, wherein the low-profile electrical connector further comprises a contact exposed through the connector body.

11. The connector of claim 1, wherein the connector body comprises two bussing interconnections arranged to receive plug connectors from directions perpendicular to one another.

12. An electrical bussing system having:

a low-profile electrical connector having a connector body including at least one bussing interconnection;

the connector body comprising an opening configured to receive at least one plug, the connector body further comprising a plurality of latch arms having features that engage the at least one plug, the latch arms having corresponding extension arms extending from the connector body and parallel and adjacent the latch arms to provide protection against damage or breakage to the latch arms; and the at least one plug having a receptacle, the receptacle having a plurality of arms and an opposing plate, the plurality of arms being configured to apply a contact force to the a structure of the at least one bussing interconnection in the direction of the opposing plate and being connectable to the structure to form an electrical connection between the structure, the plurality of arms, and the opposing plate;

wherein the engagement of the opening and the plug form a seal that substantially prevents the infiltration of moisture into the connector body.

13. The system of claim 12, wherein the opening comprises a feature for engagement with the plug.

14. The system of claim 13, wherein the opening includes connector features configured to align and retain the plug.

15. The system of claim 13, wherein the opening includes connector features that provide a moisture resistant seal when engaged with the at least one plug.

16. The system of claim 13, wherein the opening comprises a tapered surface.

17. The system of claim 12, wherein the latch arms include latch features that engage at least one surface of the at least one plug.

18. The system of claim 12, wherein the extension arms are formed into the connector body.

19. The system of claim 12, wherein the electrical devices are photovoltaic cells.

20. The system of claim 12, wherein the structure is a tabular protrusion.

21. The system of claim 12, wherein the plug includes plug features that are configured to provide a moisture resistant seal when engaged with the opening.

22. The system of claim 12, wherein the plug features comprise ribs.

23. The system of claim 12, wherein the low-profile electrical connector further comprises a contact exposed through the connector body.

24. The system of claim 12, wherein the connector body comprises two openings arranged to receive plug connectors from directions perpendicular to one another.

* * * * *